United States Patent [19]

Conte, Jr. et al.

[11] 3,977,986

[45] Aug. 31, 1976

[54] SILICONE-BASE FIRE RESISTANT HYDRAULIC FLUID

[75] Inventors: Alfeo A. Conte, Jr., Warrington, Pa.; J. Lee Hammond, Pitman, N.J.

[73] Assignee: The United States of America as represented by the Secretary of the Navy, Washington, D.C.

[22] Filed: June 2, 1975

[21] Appl. No.: 583,310

[52] U.S. Cl. ..... 252/78.3; 252/47; 252/47.5; 252/49.6; 252/54.6

[51] Int. Cl.[2] ..... C10M 3/44

[58] Field of Search ..... 252/78, 47, 47.5, 49.6, 252/54.6

[56] References Cited

UNITED STATES PATENTS

| | | | |
|---|---|---|---|
| 2,719,125 | 9/1955 | Roberts | 252/47 X |
| 2,719,126 | 9/1955 | Fields et al. | 252/47 |
| 3,048,545 | 8/1962 | Critchley et al. | 252/78 X |
| 3,146,202 | 8/1964 | Silverstein et al. | 252/49.6 |
| 3,533,943 | 10/1970 | Papayannopoulos | 252/47 X |
| 3,759,827 | 9/1973 | Groenhaf et al. | 252/54.6 X |
| 3,775,321 | 11/1973 | Turnquest et al. | 252/47 X |

*Primary Examiner*—Harris A. Pitlick
*Attorney, Agent, or Firm*—R. S. Sciascia; Henry Hansen

[57] ABSTRACT

A fire resistant silicone-base hydraulic fluid having improved antiwear properties comprising tetrachlorophenylmethyl silicone fluid, dibutylchlorendate and 2,5-bis-alkyl-dithio-1, 3, 4 thiadiazole.

3 Claims, No Drawings

SILICONE-BASE FIRE RESISTANT HYDRAULIC FLUID

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to improved fire resistant hydraulic fluids and more particularly to silicone-base hydraulic fluids having improved antiwear properties.

The currently used petroleum-base, military aircraft, hydraulic fluid, which conforms to Military Specification MIL-H-5606C is an extremely flammable material. This material, which was developed in the early phases of World War II, possesses all of the desired properties of a good hydraulic fluid with the one exception of fire resistance. Hydraulic systems in military aircraft under combat or operational conditions are subject to projectile damage or component failures which could result in the release of this fluid under pressures as high as 3,000 psi in the form of a spray or a jet. In the presence of an ignition source, a hazardous condition or fire may result, causing aircraft damage or loss and a threat to crew safety. It is clear then that military aircraft survivability can be improved by reducing their vulnerability to hydraulic fluid induced fires resulting from enemy ground fire, accidents, and system malfunctions. To this end fire resistant silicone-base hydraulic fluids have been developed. Fire resistant silicone base hydraulic fluids must not only possess the desirable properties of high flash point and high fire points but must also possess other properties which ideally equal or surpass the requirements set forth in MIL-H-5606C. For obvious reasons, one of the chief characteristics such fluids must possess is superlative antiwear properties.

SUMMARY OF THE INVENTION

Accordingly, it is an object of this invention to provide an improved fire resistant silicone base hydraulic fluid having significantly improved antiwear properties.

This object and others are achieved by providing a fire resistant hydraulic fluid which comprises a base of tetrachlorophenylmethyl silicone fluid completely admixed with 2 weight percent dibutylchlorendate and preferably 0.25 weight percent, 2,5 bis-t-dodecyl dithio-1,3,4 thiadiazole.

DESCRIPTION OF THE PREFERRED EMBODIMENT

In accordance with the present invention, there is provided a fire resistant silicone-base hydraulic fluid comprising a complete admixture of tetrachlorophenylmethyl silicone fluid, 2,5-bis-alkyldithio-1,3,4 thiadiazole (preferably 2,5-bis-t-dodecyl thio-1,3,4 thiadiazole) and dibutylchlorendate.

The additive dibutylchlorendate is a diester of the formula

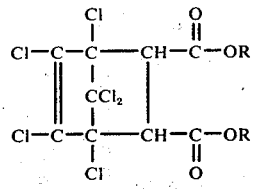

in which R is an n-alkyl radical with 4 carbon atoms. Dibutylchlorendate functions as a nitrile rubber swelling agent in the formulation of this invention and also serves to enhance the antiwear characteristics of the formulation.

The above described diester is readily formed by reacting the carboxyl groups of chlorendic acid with n-butyl alcohol. Chlorendic acid, otherwise identified as 1,4,5,6,7,7-hexachlorobicyclo (2.2.1)-hept-5-ene-2,3-dicarboxylic acid, is prepared by the Diels-Alder addition of the corresponding chlorinated cyclopentadiene and maleic anhydride. Chlorendic acid is commercially available from the Velsicol Chemical Corporation, Chicago, Illinois.

The thiadiazole used in the practice of the invention is an antiwear additive which is soluble in the silicone base fluid and which possesses desirable copper corrosion and thermal stability properties. The designated thiadiazole may be represented by the general formula

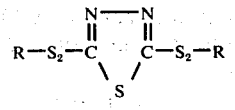

in which R is an alkyl group.

Specific examples of the thiadiazoles falling within the scope of the above formula, as well is methods of their preparation can be found in U.S. Pat. No. 2,719,125 to Roberts and U.S. Pat. No. 2,983,716 to Fields. Thiadiazoles of the type described above are commercially available from Amoco Chemical Company, Naperville, Illinois.

Specific examples of thiadiazoles which may be employed in the formulation of this invention are as follows:

a. 2,5-bis-t-hexadecyl dithio-1,3,4 thiadiazole
b. 2,5-bis-n-octyl dithio-1,3,4 thiadiazole
c. 2,5-bis-t-dodecyl dithio-1,3,4 thiadiazole In the formulation of the present invention, t-dodecyl thiadiazole is preferred because the lubricity characteristics of the formulation are most enhanced when it is used therein.

The silicon base fluid, tetrachlorophenylmethyl, used in the practice of this invention is a co-polymer having 12.5 weight percent tetrachlorophenyl siloxane and 87.5 weight percent dimethyl siloxane. It is composed of molecules varying in molecular weight from 800 to 6000; approximately 50 percent of which are between 2500 and 3500 in molecular weight.

A tetrachlorophenylmethyl silicone fluid defined by the formula:

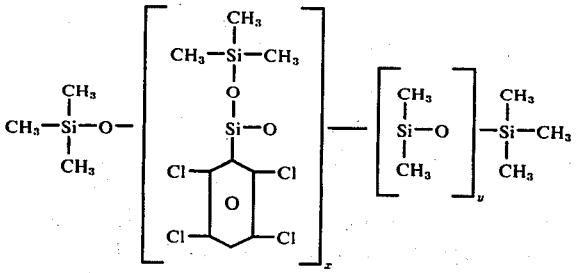

The fire resistant silicone base hydraulic fluid of the present invention is prepared by complete mixing of the three constituents with any conventional means in the presence of heat to approximately 150°–200°F. The addition of heat is not essential, however it does enhance the mixing process.

The following formulation examples are illustrative of the invention and are not to be construed as limiting. In the examples, the lubricity, i.e., antiwear, characteristics are determined by means of the Shell 4-Ball Wear test at 167 F, 40 kg, 1200 rpm, for 1 hour; AISI 52100 steel. In this test, three balls are locked immovably by a conical ring to thereby form a three point contact for a fourth ball held rigidly at the end of a drive shaft. The fourth ball rotates, under load, against the three stationary balls; all are immersed in the fluid under test. Circular scars are worn on the surface of the three stationary balls and the degree of wear is expressed as the average diameter of these scars. The smaller the wear scar, the better the lubricating characteristic of the fluid under test.

Table I sets forth wear scar results for different proportions of the three constituents of the formulation of the present invention. It also tabulates wear scar results where one or both additives are deleted for purposes of comparison.

TABLE I

| Ex. | Silicone Base Fluid (Wt/%) | Chlorendate (Wt/%) | t-dodecyl Thiadiazole (Wt/%) | Wear Scar (mm.) |
|---|---|---|---|---|
| 1 | 99.75 | 0 | 0.25 | 0.82 |
| 2 | 99.50 | 0 | 0.5 | 0.83 |
| 3 | 99 | 0 | 1.0 | 0.97 |
| 4 | 99 | 1 | 0 | 0.93 |
| 5 | 98 | 2 | 0 | 0.77 |
| 6 | 97 | 3 | 0 | 0.80 |
| 7 | 96 | 4 | 0 | 0.79 |
| 8 | 95 | 5 | 0 | 0.95 |
| 9 | 97.75 | 2 | 0.25 | 0.61–0.64 |
| 10 | 98.75 | 1.0 | 0.25 | 0.72 |
| 11 | 96.75 | 3.0 | 0.25 | 0.69 |
| 12 | 97.9 | 2.0 | 0.10 | 0.67 |
| 13 | 97.6 | 2.0 | 0.40 | 0.74 |
| 14 | 94.75 | 5.0 | 0.25 | 0.79 |
| 15 | 94.50 | 5.0 | 0.50 | 0.80 |
| 16 | 94.00 | 5.0 | 1.00 | 0.81 |
| 17 | 100.00 | 0.0 | 0.0 | 1.22–1.35 |

Formulation example 9 indicates the preferred proportions of the formulation constituents since its unexpectedly low wear scar values demonstrate that it has superior lubricating qualities. These qualities are not lost with rising temperature as demonstrated by the results tabulated in Table II wherein Formulation examples 1, 5 and 9 were subjected to the same 4-Ball Wear Test but at an increased temperature (350°F).

TABLE II

| Example | Wear Scar (mm.) 167°F | 350°F |
|---|---|---|
| 1 | 0.82 | 0.95 |
| 5 | 0.77 | 1.38 |
| 9 | 0.61–0.64 | 0.68 |

Obviously many variations of the present invention are possible in the light of the above teachings. It is therefore to be understood that within the scope of the appended claims the invention may be practiced otherwise than as specifically described.

We claim:

1. A silicone base fluid having improved lubricity characteristics comprising:

a major amount of a tetrachlorophenylmethyl silicone fluid defined by the formula

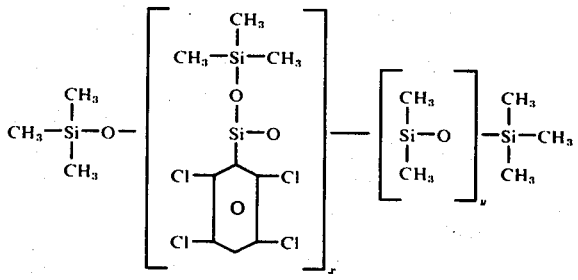

wherein the tetrachlorophenyl siloxane and the dimethyl siloxane moieties are present in amounts of 12.5 and 87.5 weight percents, respectively;

an amount in the range of from 0.1 to 0.4 percent by weight of 2,5-bis-alkyl-dithio-1,3,4 thiadiazole; and an amount in the range of from 1.0 to 3.0 percent by weight of dibutylchlorendate.

2. A silicone base fluid according to claim 1 wherein said alkyl thiadiazole is selected from the group consisting of t-hexadecyl, n-octyl and t-dodecyl thiadiazole.

3. A silicone base fluid having improved lubricity characteristics comprising:

substantially 97.75 weight percent of a tetrachlorophenylmethyl silicone fluid defined by the formula

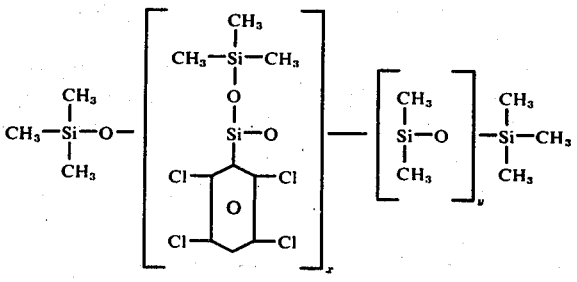

wherein the tetrachlorophenyl siloxane and the dimethyl siloxane moieties are present in amounts of 12.5 and 87.5 weight percents, respectively;

substantially 2.0 weight percent dibutylchlorendate; and substantially 0.25 weight percent 2,5 bis-t-dodecyl dithio-1,3,4 thiadiazole.

* * * * *